US009879888B2

(12) United States Patent
Uselton

(10) Patent No.: US 9,879,888 B2
(45) Date of Patent: Jan. 30, 2018

(54) AUXILIARY HEAT EXCHANGER HAVING FLUID RETENTION MEMBER FOR EVAPORATIVE COOLING

(71) Applicant: Lennox Industries Inc., Richardson, TX (US)

(72) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 692 days.

(21) Appl. No.: 13/663,778

(22) Filed: Oct. 30, 2012

(65) Prior Publication Data

US 2014/0116068 A1 May 1, 2014

(51) Int. Cl.

| | |
|---|---|
| ***F25B 21/00*** | (2006.01) |
| ***F25B 21/02*** | (2006.01) |
| ***F25B 40/02*** | (2006.01) |

(52) U.S. Cl.

CPC ..... *F25B 21/02* (2013.01); *F25B 40/02* (2013.01); *F25B 2339/041* (2013.01); *F25B 2400/0417* (2013.01)

(58) Field of Classification Search

CPC .. F25D 21/02; F25B 40/02; F25B 2400/0417; F25B 21/02

USPC ..... 62/150, 288

See application file for complete search history.

(56) References Cited

U.S. PATENT DOCUMENTS

| | | | | |
|---|---|---|---|---|
| 1,349,314 | A * | 8/1920 | Bates | F25D 21/14 184/106 |
| 2,679,144 | A * | 5/1954 | Grimshaw | F25D 21/14 62/279 |
| 5,622,057 | A * | 4/1997 | Bussjager et al. | 62/173 |
| 5,979,172 | A * | 11/1999 | Teller | 62/305 |
| 2004/0089012 | A1* | 5/2004 | Chen et al. | 62/277 |
| 2005/0166614 | A1* | 8/2005 | Dobmeier et al. | 62/150 |
| 2006/0213211 | A1* | 9/2006 | Shah et al. | 62/259.2 |
| 2007/0101749 | A1 | 5/2007 | Pham et al. | |
| 2008/0028769 | A1* | 2/2008 | Goenka | B60H 1/00328 62/3.7 |
| 2009/0019861 | A1 | 1/2009 | Heckt et al. | |
| 2010/0199693 | A1* | 8/2010 | Benesch | 62/95 |
| 2010/0281902 | A1* | 11/2010 | Kakizaki et al. | 62/239 |
| 2011/0005256 | A1* | 1/2011 | Terry | 62/259.1 |

OTHER PUBLICATIONS

Yang, Dr. Bao, Thermoelectric Technology Assessment, May 2007, 188 pages, ARTI Report No. 10120-01, University of Maryland at College Park, Maryland, US.

Winkler, Jonathan, et al., Potential Benefits of Thermoelectric Element Used with Air-Cooled Heat Exchangers, Purdue e-Pubs, International Refrigeration and Air Conditioning Conference, 2006, 9 pages, Purdue University Libraries, US (Paper 813, available online at http://docs.lib.purdue.edu/iracc/813).

* cited by examiner

*Primary Examiner* — David Teitelbaum
(74) *Attorney, Agent, or Firm* — Baker Botts L.L.P.

(57) ABSTRACT

An auxiliary heat exchanger may reduce a temperature of a refrigerant allowed to pass through the auxiliary heat exchanger. The operation of the auxiliary heat exchanger may be controlled. In some implementations, the auxiliary heat exchangers may include fluid retention members, thermoelectric coolers, and/or other types of heat exchangers.

6 Claims, 7 Drawing Sheets

AUXILIARY HEAT EXCHANGER HAVING FLUID RETENTION MEMBER FOR EVAPORATIVE COOLING

TECHNICAL FIELD

The present disclosure relates to air conditioners, and more particularly to auxiliary component(s) in air conditioners.

BACKGROUND

Air conditioners provide cool air by evaporating cool liquid refrigerant. Cool refrigerant is provided to evaporators by condensers, during operation. The temperature of the cool liquid refrigerant provided by the condenser is dependent on the ambient temperature. The condensers condense hot gaseous refrigerant delivered from a compressor to a cooler liquid refrigerant. A condenser fan may blow air on the hot gaseous refrigerant to remove heat from the gaseous refrigerant.

SUMMARY

In various implementations, a system may include an auxiliary heat exchanger. The auxiliary heat exchanger may include a first surface and an opposing second surface. Fluid retention member(s) may be coupled to at least a portion of the first surface and/or a refrigerant conduit may be coupled to at least a portion of the second surface. A temperature of at least a part of the refrigerant in the refrigerant conduit may be reduced by heat transfer from the refrigerant to at least one of the fluid retention members.

Implementations may include one or more of the following features. The auxiliary heat exchanger may include a condensate line coupled to at least one of the fluid retention members. The auxiliary heat exchanger may include a container coupled to at least one of an evaporator or a water line. A fluid leaving the container may flow to at least one of the fluid retention members. The container may automatically allow water to flow from the water line into the container when a fluid level in the container is less than a predetermined fluid level. The system may include an air conditioner that includes a switch. The switch may control the operation of the auxiliary heat exchanger. The auxiliary heat exchanger reduces a temperature of at least a portion of the refrigerant leaving a condenser of the air conditioner. At least one of the fluid retention members may include channels. The channels may retain fluid at least partially in the channels. Air may flow proximate the channels and at least partially evaporate the fluid at least partially retained in the channels to reduce a temperature of at least a part of the refrigerant.

In various implementations, a system may include an auxiliary heat exchanger. The auxiliary heat exchanger may include a first surface and a second opposing surface. The auxiliary heat exchanger may include thermoelectric cooler (s) coupled to at least a portion of the first surface of the auxiliary heat exchanger and/or a refrigerant conduit coupled to at least a portion of the second surface of the auxiliary heat exchanger. A temperature of at least a part of the refrigerant in the refrigerant conduit may be reduced by heat transfer to at least one of the thermoelectric coolers.

Implementations may include one or more of the following features. A temperature of a refrigerant leaving the auxiliary heat exchanger may be less than approximately 3° F. above an ambient temperature. The auxiliary heat exchanger may include an air inlet and an air outlet. At least a portion of the air from the condenser blower may flow through the air inlet to the air outlet. A portion of the air may remove heat from at least one of the thermoelectric coolers. The system may include an air conditioner and the air conditioner may include the auxiliary heat exchanger. The auxiliary heat exchanger may reduce a temperature of at least a portion of the refrigerant leaving the condenser of the air conditioner. The auxiliary heat exchanger may be at least partially coupled to the condenser of the air conditioner. The auxiliary heat exchanger may include a converter to convert alternating current to direct current. The converter may provide direct current to at least one of the thermoelectric coolers. The system may be a retrofit kit to couple to an air conditioner.

Various implementations may include providing refrigerant to a condenser of an air conditioner and condensing the refrigerant to a liquid at a first temperature using the condenser. A determination may be made whether a request to operate the auxiliary heater has been received. If the request for operation of the auxiliary heat exchanger has been received: the liquid refrigerant may be provided at the first temperature to the auxiliary heat exchanger; the auxiliary heat exchanger may be allowed to reduce the temperature of the refrigerant in the auxiliary heat exchanger to a second temperature; and at least a portion of the refrigerant may be provided at the second temperature to the evaporator.

Implementations may include one or more of the following features. Allowing the auxiliary heat exchanger to reduce the temperature of the refrigerant in the auxiliary heat exchanger to a second temperature may include: allowing a fluid to flow to one or more fluid retention members at least partially coupled to a first surface of the auxiliary heat exchanger; allowing the refrigerant to flow through a refrigerant conduit at least partially coupled to a second surface of the auxiliary heat exchanger; and/or allowing heat to transfer between the refrigerant in the refrigerant conduit and at least one of the fluid retention members. A temperature of the refrigerant may be reduced to the second temperature by the heat transfer from the refrigerant to at least one of the fluid retention members. The second surface may be opposed to the first surface of the auxiliary heat exchanger. Condensate from the evaporator of the air conditioner may be allowed to flow into a container. A determination may be made whether to allow water from a water line to flow into the container. The water may be allowed to flow into the container if the determination is made to allow water from the water line to flow into the container. A fluid may be allowed to flow from the container to at least one of the fluid retention members.

Allowing the auxiliary heat exchanger to reduce the temperature of the refrigerant in the auxiliary heat exchanger to a second temperature may include: allowing one or more thermoelectric coolers at least partially coupled to a first surface of the auxiliary heat exchanger to operate; allowing the refrigerant to flow through a refrigerant conduit at least partially coupled to a second surface of the auxiliary heat exchanger; and allowing heat to transfer between the refrigerant and at least one of the thermoelectric coolers. A temperature of at least a part of the refrigerant in the refrigerant conduit may be reduced to a second temperature by the heat transfer from the refrigerant to at least one of the thermoelectric coolers. At least a portion of the liquid refrigerant at the first temperature may be provided to an evaporator of the air conditioner, if the request to operate the auxiliary heater has not been received. When the request to operate the auxiliary heater has been received, a temperature of the refrigerant may be reduced to a second temperature that may be less than approximately 3° F. above an ambient temperature. The air conditioner may include a default setting to request operation of the auxiliary heat exchanger.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

In various implementations, the temperature of refrigerant in an air conditioner may be reduced using an auxiliary heat exchanger. For example, an auxiliary heat exchanger may reduce the temperature of refrigerant exiting a condenser of the air conditioner using fluid retention member(s), thermoelectric cooler(s), and/or other appropriate heat exchanger (s).

Figure 1:
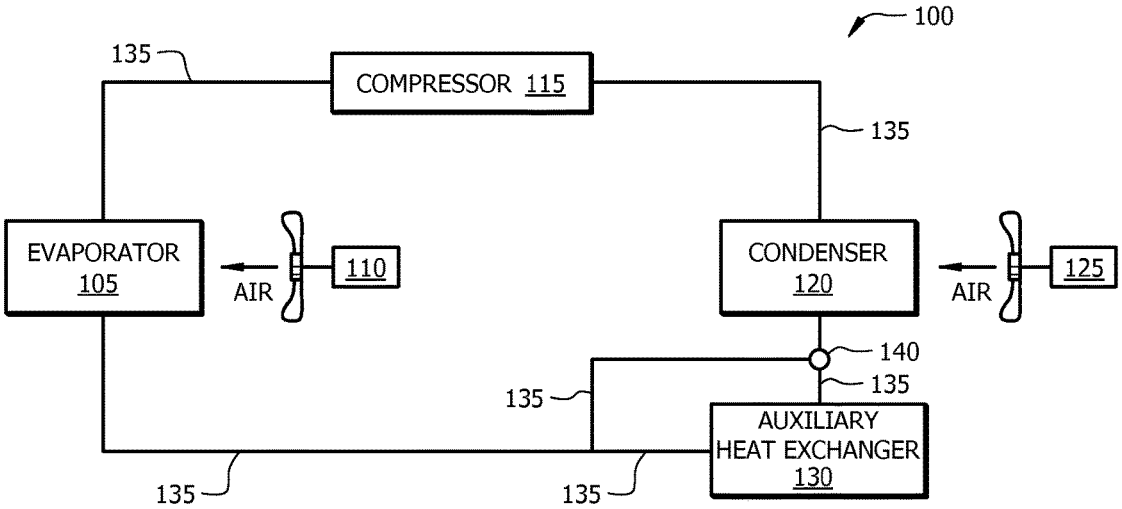
FIG. 1 illustrates an implementation of an example of an air conditioner.

FIG. 1 illustrates an implementation of an example air conditioner 100. The air conditioner 100 may include components such as an evaporator 105, evaporator fan 110, compressor 115, condenser 120, condenser fan 125, and auxiliary heat exchanger 130. The air conditioner 100 may include a thermal expansion valve (not shown) and/or control system (not shown) to manage operations of the air conditioner. One or more of the components may be coupled through refrigerant lines 135 (e.g., conduit between components at least partially containing refrigerant during use). During use, the evaporator 105 allows liquid refrigerant (e.g., R-22 and/or R-410A) to evaporate to form a gaseous refrigerant that is provided to the compressor 115. At least a portion of the air from the evaporator fan 110 may flow at least partially through the evaporator 105 and the cooler air exiting the evaporator may be provided (e.g., via ducting) to a location.

The compressor 115 may increase the pressure of the gaseous refrigerant and the higher pressure gas is provided to the condenser 120. The condenser 120 allows at least a portion of the gaseous refrigerant to condense into a liquid. At least a portion of the air from the condenser fan 125 may flow at least partially through the condenser 120 and absorb heat from the refrigerant, which may allow at least portions of the gaseous refrigerant to liquefy.

At least a portion of the liquid refrigerant from the condenser 120 may be allowed to flow to the auxiliary heat exchanger 130. For example, the air conditioner 100 may include a switch 140 that allows fluid flow (e.g., at least a part of the refrigerant from the condenser and/or at least a part of the air from the condenser fan) to be directed to and/or bypass the auxiliary heat exchanger 130. A controller (e.g., a computer) may determine whether to allow fluid flow to the auxiliary heat exchanger 130. For example, a controller may respond to a user request for operation of the auxiliary heat exchanger 130. In some implementation, a controller may determine whether to operate the auxiliary heat exchanger 130 based on a request from a user (e.g., when cooling is requested by a user during high ambient temperatures, such as above 85° F.). An air conditioner may include a default setting, such as to allow operation of the auxiliary heat exchanger 130 and/or to restrict operation of the air conditioner without use of the auxiliary heat exchanger. In some implementations, at least a part of the refrigerant may bypass the auxiliary heat exchanger and flow to the evaporator. In some implementations, the air conditioner 100 may include a metering device (not shown), such as a thermal expansion valve. The liquid refrigerant may be allowed to at least partially pass from the auxiliary heat exchanger 130 and/or condenser 120 through the thermal expansion valve. The thermal expansion valve may allow and/or restrict fluid flow through the valve at least partially based on the automatic adjustment of the thermal expansion valve and/or the control system.

The auxiliary heat exchanger 130 may reduce the temperature of at least a part of the refrigerant from the condenser 120. When the refrigerant leaves the auxiliary heat exchanger 130, the refrigerant may be at an exit temperature less than a predetermined temperature. For example, the exit temperature of the refrigerant may be: less than approximately one degree Fahrenheit above ambient temperature (e.g., Ambient temperature+approximately 1° F.); and/or less than approximately three degrees Fahrenheit above ambient temperature (e.g., Ambient temperature+ approximately 3° F.). The exit temperature of the refrigerant may be less than or approximately equal to ambient temperature.

Ambient temperature may be a temperature proximate at least a portion of the auxiliary heat exchanger 130, the condenser 120, and/or the condenser fan 125 (e.g., ambient temperature may be a temperature proximate an opening of an auxiliary heat exchanger). A sensor may be positioned proximate the condenser 120 and a controller may be coupled to the sensor to determine the ambient temperature.

By reducing the temperature of the refrigerant entering the evaporator 105, the capacity of the evaporator may be increased. When the capacity of the evaporator 105 is increased, the EER (energy efficiency ratio) may be increased. For example, since the temperature of the refrigerant is cooler (e.g., than in a system without an auxiliary heat exchanger), more heat may be transferred from air proximate the evaporator 105 and thus, more cool air can be provided to a location in response to a user request. The boost in capacity of the evaporator 105 may allow an air conditioner to operate more effectively (e.g., more responsive to a user request, be able to provide cooler air, and/or operation may be less likely to cause mechanical failure). An air conditioner with an auxiliary heat exchanger may have a higher EER rating than a similar air conditioner without an auxiliary heat exchanger (e.g., an air conditioner with at least some similarly sized components) because the cooling capacity of the air conditioner may be increased with little and/or no increase in energy use, in some implementations.

In some implementations, auxiliary heat exchanger 130 may be similar to the condenser 120. For example, the auxiliary heat exchanger 130 may be a heat exchanger similar to and smaller in scale (e.g., in output capabilities) than the condenser 120. For example, the auxiliary heat exchanger 130 may include a second refrigerant that cools the refrigerant from the condenser 120. The second refrigerant may be the same and/or different from the refrigerant from the condenser 120. Mixing between the refrigerant from the condenser 120 and the second refrigerant may be inhibited. A second compressor of the auxiliary heat exchanger 130 may compress the second refrigerant. The compressor of the auxiliary heat exchanger 130 may be separate from the compressor 120 of the air conditioner. The compressed second refrigerant may be allowed to flow to a second condenser (e.g., a second condenser unit and/or a portion of the condenser of the air conditioner) to cool the first refrigerant (e.g., the refrigerant flowing from the condenser 120 to the evaporator 105 of the air conditioner 100).

Figure 2A:
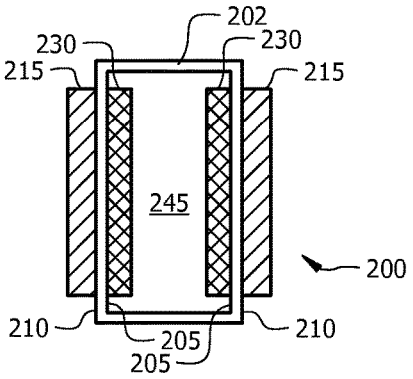
FIG. 2A illustrates a cross-sectional view of an implementation of an example auxiliary heat exchanger.
Figure 2B:
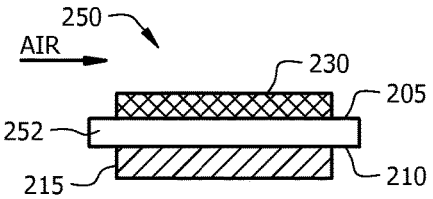
FIG. 2B illustrates a cross-sectional view of an implementation of an example auxiliary heat exchanger.
Figure 3:
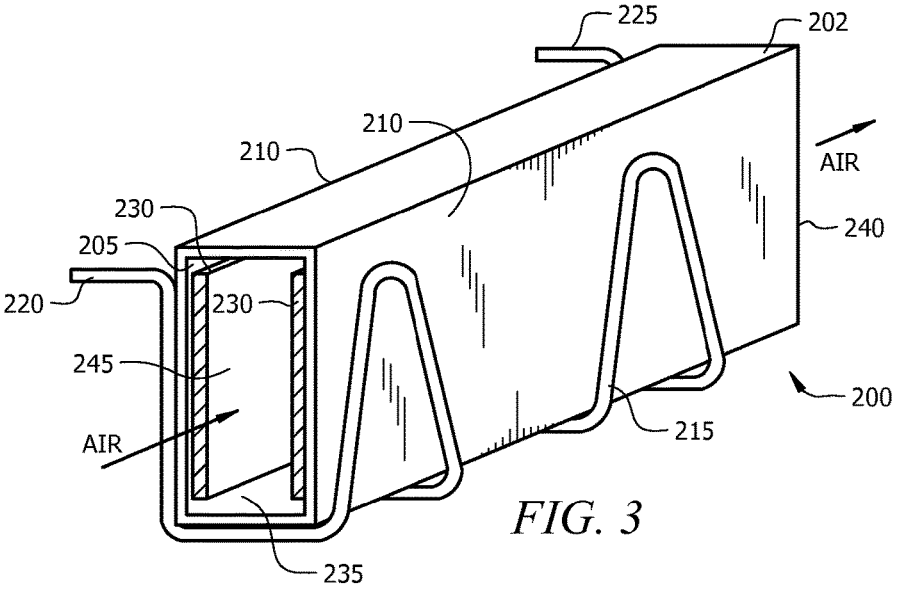
FIG. 3 illustrates a perspective view of an implementation of an example auxiliary heat exchanger.

In some implementations, the auxiliary heat exchanger 130 may include components, such as fluid retention member(s) and/or thermoelectric cooler(s). FIG. 2A illustrates a cross-sectional view of an implementation of an example of an auxiliary heat exchanger 200. FIG. 2B illustrates a cross-sectional view of an implementation of an example auxiliary heat exchanger 250. FIG. 3 illustrates a perspective view of an implementation of an example of an auxiliary heat exchanger 200.

The auxiliary heat exchanger may include a housing. The housing may include thermally conductive material. The auxiliary heat exchanger and/or housing may have a cross-sectional shape similar to a circle, oval, line, c-shaped, and/or any other appropriate shape. For example, as illustrated in FIGS. 2A and 3, a housing 202 of the auxiliary heat exchanger 200 may have a rectangular cross-sectional shape. The auxiliary heat exchanger may be tubular. As illustrated in FIG. 2B, a housing 252 of the auxiliary heat exchanger 250 may be a plate (e.g., with planar and/or curved sections). In some implementations, the auxiliary heat exchanger may include two plates (e.g., with planar and/or curved sections) and an opening disposed between the plates. In some implementations, a shape of an auxiliary heat exchanger may be selected to control air flow. For example, as illustrated in FIGS. 2A and 3, the rectangular cross-sectional shape of the housing 202 may restrict airflow to the opening 245 disposed in the housing.

As illustrated in FIGS. 2A, 2B, and 3, the auxiliary heat exchanger 200, 250 may include two opposing surfaces, a first surface 205 and a second surface 210. For example, as illustrated in FIGS. 2A and 3, the first surface 205 may be at least a portion of an inner surface of the auxiliary heat exchanger 200 and/or the second surface 210 may be at least a portion of the outer surface of the auxiliary heat exchanger. As illustrated in FIG. 2B, the first surface 205 and the second surface 210 may be opposing sides of a plate (e.g., a plate with curved and/or planar portions) of the auxiliary heat exchanger 250.

The auxiliary heat exchanger 200, 250 may include a refrigerant line 215 disposed proximate the second surface 210. The refrigerant line 215 may be coupled to at least a portion of the second surface 210. For example, the refrigerant line 215 may be coupled to at least a portion of the second surface 210 using clips, soldering, brazing, and/or welding. The refrigerant line 215 may include a refrigerant inlet 220 and a refrigerant outlet 225.

The auxiliary heat exchanger 200, 250 may include fluid retention member(s) 230 disposed proximate the first surface 205. The fluid retention member(s) 230 may be coupled to at least a portion of the first surface 205. The fluid retention member 230 may be glued to a portion of the first surface 205, for example. In some implementations, the fluid retention member 230 may be a portion of and/or integrated with the first surface 205 of the auxiliary heat exchanger 200, 250.

As illustrated in FIGS. 2A and 3, the auxiliary heat exchanger 200 may include an air inlet 235 and an air outlet 240. Air may flow at least partially through an opening 245 disposed between the opposing first surfaces 205. The air flow may be generated by the condenser fan. For example, a portion of the air flow generated by the condenser fan may be directed to the auxiliary heat exchanger 200. The air flow may enter the auxiliary heat exchanger 200 at and/or proximate to the air inlet 235 and leave the auxiliary heat exchanger at and/or proximate to the air outlet 240.

As illustrated in FIGS. 2A and 3 the air flow (e.g., from a condenser fan) through the opening 245 of the auxiliary heat exchanger 200 may remove heat (e.g., from the first surface 205 and/or a fluid retention member 230) As illustrated in FIG. 2B, air (e.g., from a condenser fan) may flow proximate a surface of the fluid retention member 230. A fluid, such as water from condensate and/or a water line, may be disposed and/or retained at least partially on the fluid retention member 230. The water may have a lower temperature than the refrigerant in the refrigerant line 215. Heat from the refrigerant may be transferred to the refrigerant conduit 215. The heat from the refrigerant conduit 215 may be transferred through a housing 202, 252 of the auxiliary heat exchanger 200, 250 to fluid retention member(s) 230. The heat from a fluid retention member 230 may be transferred to the fluid at least partially retained by the fluid retention member. As the air flow proximate the fluid retention member 230, at least a portion of the fluid in the fluid retention member may evaporate. The fluid may evaporate due to the heat transfer from refrigerant, refrigerant conduit 215, housing 202, 252, fluid retention member 230, and/or air flow. Approximately 1000 BTUs of energy may be absorbed by evaporation of each pound of the fluid (e.g., water) and so, heat may be removed from the refrigerant and the temperature of the refrigerant may be reduced.

In some implementations, as illustrated in FIGS. 2A, 2B, and 3, the first surface 205 may be cooled (e.g., a temperature may be reduced) by the evaporation of the fluid at least partially retained by the fluid retention member(s) 230. The cooling of the first surface 205 may cool the second surface 210, the housing 202, 252, the refrigerant conduit 215, and/or the refrigerant. Thus, the evaporation of fluid from the fluid retention members 230 may cool and/or reduce the temperature of the refrigerant.

In some implementations, the fluid retention members 230 may at least partially absorb fluid and/or at least partially retain fluid. The fluid retention member 230 may retain fluid for a period of time and then allow fluid to flow from the fluid retention member. For example, the fluid retention member 230 may retain a fluid and allow the fluid to evaporate from the fluid retention member.

Figure 4:
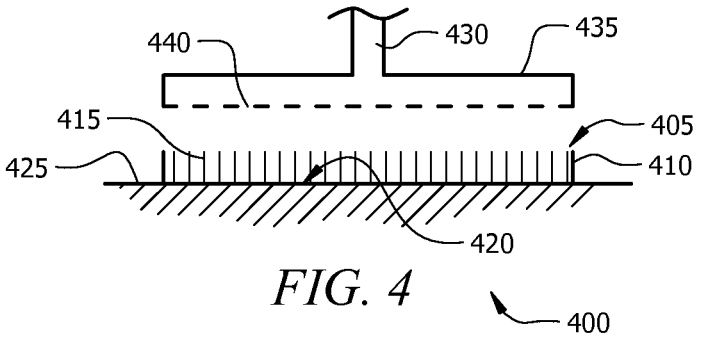
FIG. 4 illustrates a cross-sectional view of an implementation of a portion of an example auxiliary heat exchanger.

The fluid retention members 230 may include an absorbent pad (e.g., a cloth), a coated member, a plate with bristles, fins, channels, tubing, and/or a flocked plate. For example, a flocked plate may include a plate with fibers coupled in a normal direction to the plate. FIG. 4 illustrates an implementation of a portion 400 of an auxiliary heat exchanger. As illustrated, the fluid retention member 405 includes flocking 410. The flocking 410 may include fibers 415. The fibers 415 may be coupled to the plate 420 such that the fibers are normal to the plate. The fibers 415 may retain fluid in and/or within the fluid retention member 405. The flocking 410 may include polyester fibers coupled to a surface of the fluid retention member 405, as an example. In some implementations, the fluid retention member 405 may include channels (e.g., disposed between fibers 415 and/or formed in the fluid retention members) and/or recesses to at least partially retain (e.g., temporarily retain and/or retain a portion of) the fluid).

The fluid retention member 405 may be coupled to a portion of the first surface 425 of the auxiliary heat exchanger. In some implementations, the fluid retention member 405 may be a portion of and/or formed in the first surface 425 of the auxiliary heat exchanger. The fluid retention member 405 may be glued to a first surface 425 of the auxiliary heat exchanger 405, for example. In some implementations, the fibers 415 may be glued directly to the first surface 425 of the auxiliary heat exchanger.

The auxiliary heat exchanger may include a conduit 430 coupled to a distributer 435 to deliver a fluid to the fluid retention member 405. The distributer 435 may include a plurality of openings 440. During use, a fluid, such as water (e.g., from condensate and/or water from a water line), may be delivered to the auxiliary heat exchanger via the conduit 430. The distributer 435 may deliver fluid from the conduit 430 to the fluid retention member 405. The openings 440 may provide the fluid across a surface of the fluid retention member 405. For example, the fluid may flow from the openings 440 and be at least partially retained by the fibers 415 and/or channels of the fluid retention member 405.

Various implementations of auxiliary heat exchangers have been described as including a housing to which fluid retention members and/or refrigerant conduit are coupled, as examples. In some implementations, the fluid retention member may be directly coupled to a refrigerant conduit such that a first surface and a second surface are surfaces of the refrigerant conduit. In some implementations, the refrigerant conduit may be coupled to a portion of the fluid retention member (e.g., a plate of the fluid retention member). In some implementations, the fluid retention member may include flocked vertical fins proximate a refrigerant conduit.

Figure 5:
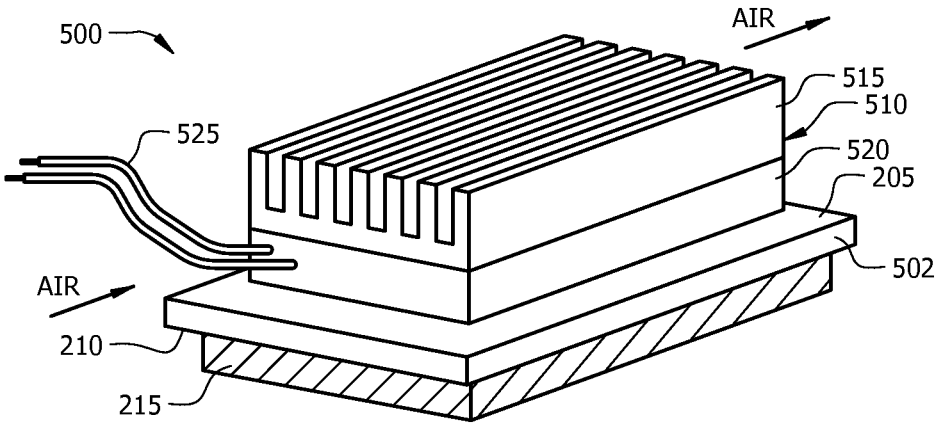
FIG. 5 illustrates a perspective view of an implementation of an example auxiliary heat exchanger.

In some implementations, the auxiliary heat exchanger may include thermoelectric cooler(s). FIG. 5 illustrates an implementation of an example auxiliary heat exchanger 500 comprising a thermoelectric cooler 510. The auxiliary heat exchanger 500 may include a housing 502, such as a plate. The thermoelectric cooler 510 may be disposed in an auxiliary heat exchanger similarly to a fluid retention member. The thermoelectric cooler 510 may be coupled to at least a portion of the first surface 205 of the housing 502 of the auxiliary heat exchanger 500 and the refrigerant line 215 may be coupled at least partially to the second surface 210 of the housing 502. In some implementations, the thermoelectric cooler 510 may include a portion configured to couple to a portion of the condenser (e.g., a portion of the condenser may function as the auxiliary heat exchanger and reduce the temperature of the refrigerant lower than the condenser could without the auxiliary heat exchanger). For example, a heat resistant coupling may be included on a surface of the thermoelectric cooler 510 to affix the thermoelectric cooler to a part of the condenser.

The thermoelectric cooler may include any appropriate thermoelectric cooler, such as a thermoelectric cooler commercially available from Marlow Industries (Dallas, Tex.) and/or devices that utilize Peltier effects. The thermoelectric cooler may be coupled to a battery or other power source (e.g., through wires 525 coupled to the thermoelectric cooler). In some implementations, a converter (e.g., AC to DC) may be coupled to the thermoelectric cooler so that the thermoelectric cooler may operate using the same power source as the air conditioner.

The thermoelectric cooler 510 may include opposing hot 515 and cold 520 sides. For example, during use the thermoelectric cooler 510 may generate a cold side 520 and a hot side 515. The temperature of the cold side 520 may be less than a temperature of the hot side 515. The cold side 520 of the thermoelectric cooler may be coupled to the first surface 205 of the housing 502 of the auxiliary heat exchanger 500 and the refrigerant line 215 may be coupled to the second surface 210 of the housing 502 of the auxiliary heat exchanger 500. During use, heat may transfer from the refrigerant in the refrigerant line 215, to the housing 502, and/or to the cold side 520 of the thermoelectric cooler 510. Air from a condenser fan may direct air towards the hot side 515 of the thermoelectric cooler and/or remove heat from the hot side. Thus, the temperature of the refrigerant may be reduced by the thermoelectric cooler, in some implementations.

Figure 6:
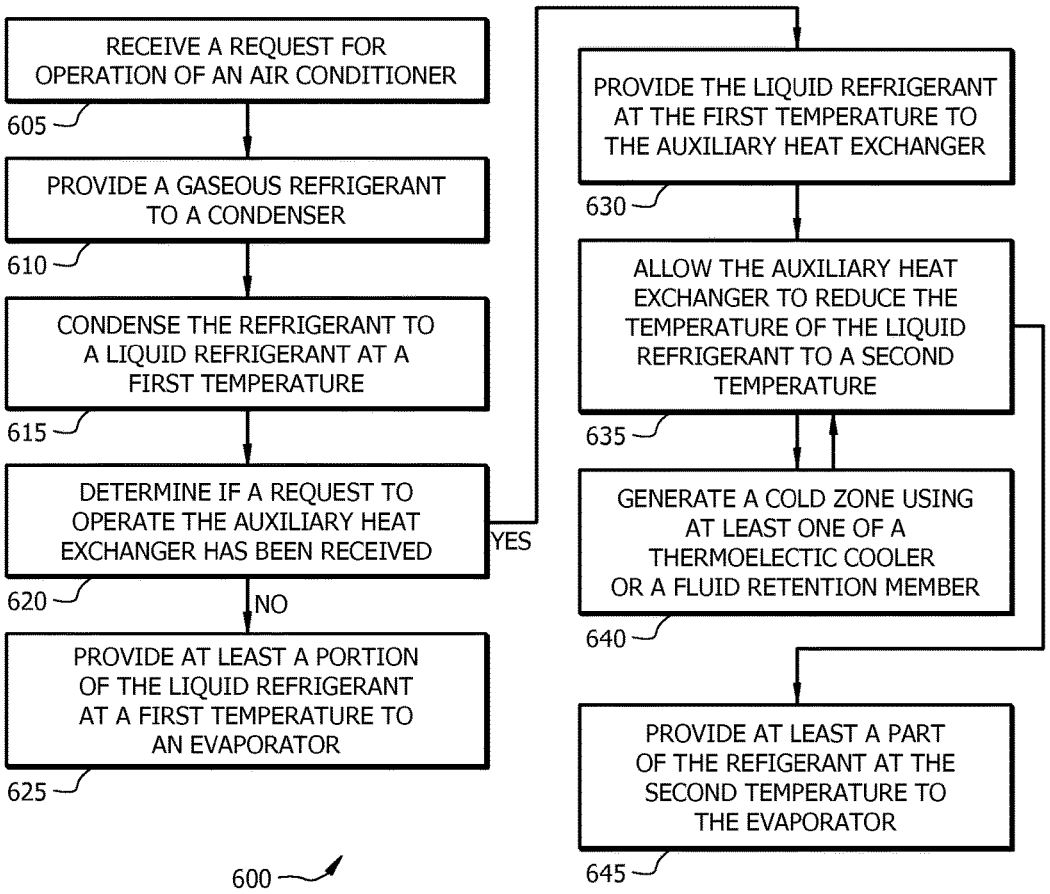
FIG. 6 illustrates an implementation of an example process for operation of an air conditioner.

FIG. 6 illustrates an implementation of an example process 600 for operation of an air conditioner. A request for operation of an air conditioner may be received (operation 605). For example, a user may request that cold air be delivered to a location.

A gaseous refrigerant may be provided to a condenser (operation 610). During operation of the air conditioner, refrigerant may provide cool air to a location using the evaporator and ducting to a location (e.g., cool air provided by the evaporator and evaporator blower may be transported to the location using the ducting). The refrigerant may leave the evaporator as a gas, be at least partially compressed, and provided to the condenser.

The refrigerant may be at least partially condensed to a liquid refrigerant at a first temperature (operation 615). For example, the condenser may condense the gaseous refrigerant that has been compressed. The liquid refrigerant leaving the condenser may be at a first temperature. Since the heat exchange in the condenser is between the air at ambient temperature and the refrigerant, the temperature to which the refrigerant can be lowered may be restricted by the temperature of the air. The first temperature may be, for example, at least ten degrees Fahrenheit greater than ambient temperature (e.g., 10° F.+Ambient temperature).

Whether a request to operate the auxiliary heat exchanger has been received may be determined (operation 620). For example, the controller of an air conditioner may monitor ambient temperatures and automatically allow the auxiliary heat exchanger to operate during a predetermined temperature range (e.g., temperatures greater than 82° F., temperatures greater than 116° F.). As another example, a default setting of an air conditioner may include a request that an auxiliary heat exchanger operation be allowed and/or restricted. In some implementations, a user may request operation of the auxiliary heat exchanger.

At least a part of the refrigerant at the first temperature may be provided to the evaporator of the air conditioner, if a determination has been made that a request to operate the auxiliary heat exchanger has not been received (operation 625). For example, the auxiliary heat exchanger may be bypassed and the refrigerant may flow from the condenser to an expansion valve and/or evaporator. In some implementations, the auxiliary heat exchanger may be turned off or remain off when the request to operate the auxiliary heat exchanger has not been received. For example, the air flow to the auxiliary heat exchanger may be turned off, and/or water flow from the condensate and/or other source may be restricted. Thus, even though the refrigerant at the first temperature flows through the auxiliary heat exchanger, the auxiliary heat exchanger does not substantially lower the temperature of the refrigerant.

In some implementations, operation of an auxiliary heat exchanger may be not requested and/or the auxiliary heat exchanger may be bypassed. For example, to increase the length of a cooling cycle, the operation of the auxiliary heat exchanger may be restricted. For example, when the auxiliary heat exchanger is used in conjunction with the condenser on cold days (e.g., 65 degrees Fahrenheit), the air conditioner may quickly reach a temperature requested by the user and quickly cycle on and off. The quick cycle (e.g., short and repetitive cycles) may stress the air conditioner and/or may lead to premature mechanical failure of the air conditioner. Thus, an auxiliary heat exchanger may be bypassed and the air conditioner may operate for longer cycles (e.g., compared to operations using the auxiliary heat exchanger) using the condenser and restricting use of the auxiliary heat exchanger (e.g., bypass the auxiliary heat exchanger).

At least a part of the liquid refrigerant at the first temperature may be provided to the auxiliary heat exchanger, if a determination has been made that a request to operate the auxiliary heat exchanger was received (operation 630). For example, a user may request operation of the auxiliary heat exchanger. When temperatures are high (e.g., greater than 82° F.), the auxiliary heat exchanger may allow the evaporator to have a greater capacity (e.g., because a temperature of the refrigerant provided to the evaporator is lower than the temperature of the refrigerant exiting the condenser) when compared to a similar air conditioner without an auxiliary heat exchanger (e.g., an air conditioner with one or more similarly sized components, such as a condenser).

The auxiliary heat exchanger may be allowed to reduce the temperature of the liquid refrigerant to a second temperature (operation 635). Since heat is transferred between a cold zone in the auxiliary heat exchanger and the refrigerant, a lower temperature may be obtained in the refrigerant (e.g., when compared with the refrigerant temperature exiting the condenser and/or when use of the auxiliary heat exchanger is restricted). For example, the auxiliary heat exchanger may be allowed to reduce the temperature of the liquid refrigerant to a temperature approximately equal to and/or less than ambient temperature (e.g., a temperature proximate at least a portion of the condenser). The temperature of the refrigerant leaving the auxiliary heat exchanger may be less than or approximately equal to 3° F. more than ambient temperature. In some implementations, the auxiliary heat exchanger may reduce the temperature of the refrigerant by a predetermined amount (e.g., reduce the temperature approximately 3° F., 5° F., and/or 10° F.). The auxiliary heat exchanger may reduce the temperature of the refrigerant to approximately equal to ambient temperature or less than ambient temperature, in some implementations.

A cold zone may be generated proximate a surface of an auxiliary heat exchanger using a thermoelectric cooler and/or a fluid retention member (operation 640). For example, a thermoelectric cooler and/or fluid retention member may be coupled to a surface of the auxiliary heat exchanger. The thermoelectric cooler and/or fluid retention member may be allowed to operate such that the surface of the auxiliary heat exchanger proximate the thermoelectric cooler and/or fluid retention member (e.g., first surface) is colder than ambient temperature. Thus, heat from the refrigerant may be transferred to the cold zone and/or removed from the cold zone, in some implementations. When a thermoelectric cooler is used, the air flows across the hot side and may allow the thermoelectric cooler to continue to operate properly (e.g., inhibit overheating). The refrigerant may leave the auxiliary heat exchanger (e.g., via the refrigerant line outlet) at a second temperature. The second temperature may be less than the temperature that at which the refrigerant entered the auxiliary heat exchanger (e.g., via the inlet of the refrigerant line).

At least a part of the liquid refrigerant at the second temperature may be provided to the evaporator of the air conditioner (operation 640). For example, the liquid refrigerant may flow from the auxiliary heat exchanger to the evaporator. In some implementations, a thermal expansion valve may be included to control flow of the refrigerant to the evaporator. The thermal expansion valve may be disposed on a refrigerant line such that refrigerant enters the thermal expansion valve (e.g., from the auxiliary heat exchanger and/or from the condenser, when bypassing the auxiliary heat exchanger) prior to entering the evaporator. Providing cooled refrigerant at a second temperature may increase a capacity of the evaporator (e.g., when compared with the capacity of the evaporator when cooled refrigerant at the first temperature is provided).

Figure 9:
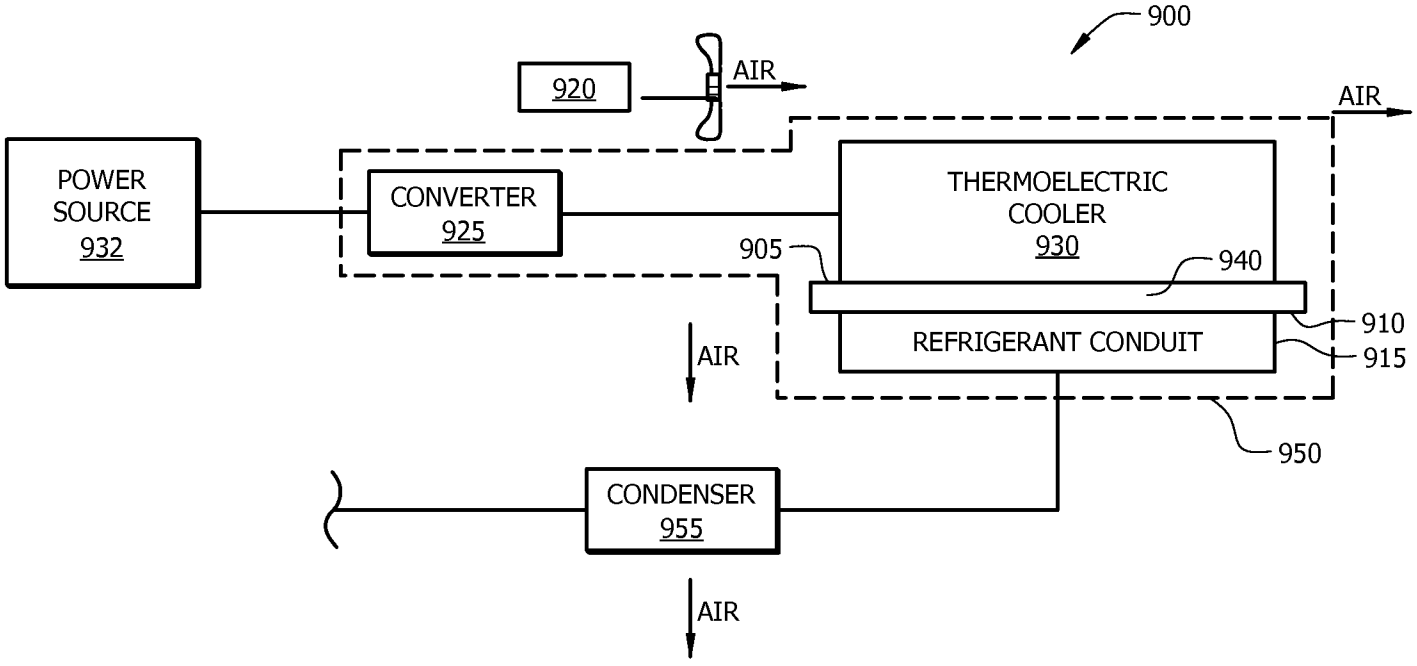
FIG. 9 illustrates an implementation of a portion of an example air conditioner.
Figure 10:
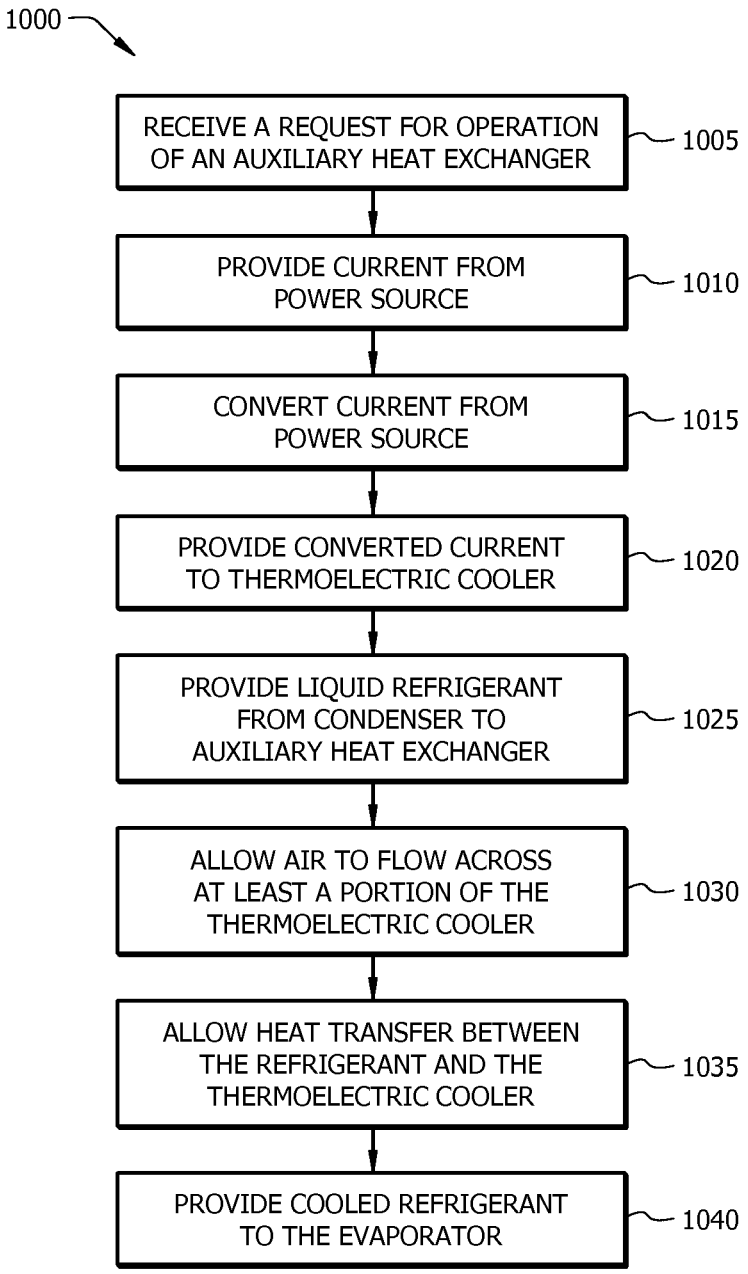
FIG. 10 illustrates an implementation of an example process for operation of an auxiliary heat exchanger.

Process 600 may be implemented by various systems, such as system 100, 200, 250, 400, 500, 700 (illustrated in FIG. 7), and/or 900 (illustrated in FIG. 9). In addition, various operations may be added, deleted, or modified. For example, sensors may be used to determine temperature(s). As another example, an auxiliary heat exchanger may be a second condenser system (e.g., a condenser, a compressor, and/or second refrigerant). A switch may allow the second condenser system to function as an auxiliary heat exchanger and be utilized when requested by the system and/or users (e.g., the second condenser may be turned on and/or off). The second condenser may generate a cold zone that allows heat transfer from the refrigerant from the first condenser (e.g., to a second refrigerant). The temperature of the refrigerant from the first condenser may be lower when exiting the second condenser than when entering the second condenser. For example, the temperature of the refrigerant from the first condenser may be reduced by at least approximately two degrees and/or approximately 3 degrees. In some implementations, the auxiliary heat exchanger may not include a fluid retention member or thermoelectric cooler. The auxiliary heat exchanger may include a second refrigerant, which is evaporated, compressed and/or condensed to provide a cool zone in the auxiliary heat exchanger and cool the refrigerant from the condenser.

Figure 7:
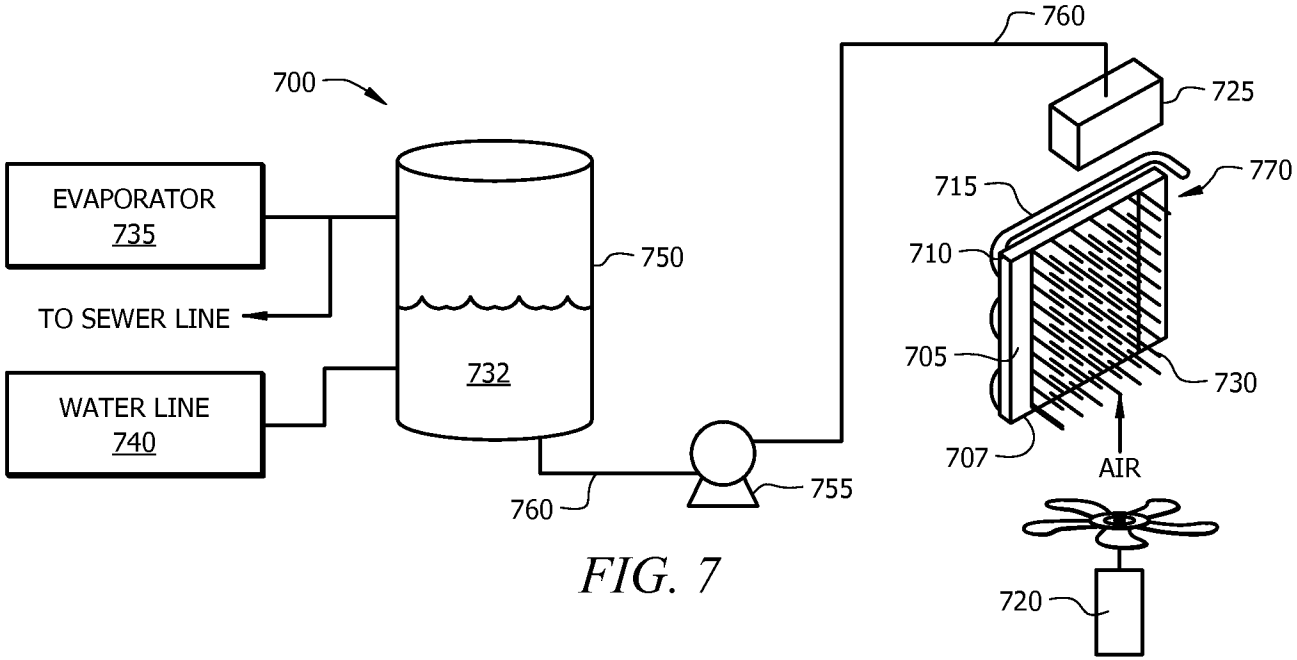
FIG. 7 illustrates an implementation of a portion of an example air conditioner.

In some implementations, a fluid retention member may be utilized to generate a cold zone proximate a surface of the auxiliary heat exchanger. FIG. 7 illustrates an implementation of an example of a portion 700 of an air conditioner system. The auxiliary heat exchanger 770 may include a fluid retention member 730 and a refrigerant line 715 coupled to opposing surfaces (e.g., first surface 705 and second surface 710) of a housing 707 (e.g., a plate) of the auxiliary heat exchanger. At least a portion of an air flow generated by a fan 720 (e.g., condenser blower fan and/or a separate auxiliary heat exchanger fan) may be directed across the fluid retention member 730. The air flow may facilitate heat transfer between the fluid retention member 730 and/or fluids 732 residing at least partially in the fluid retention member and the refrigerant in the refrigerant line 715. For example, the air flow may cool the fluid retention member 730 and/or first surface 705 of the housing 707 by allowing evaporation of at least a part of the fluid at least partially retained by the fluid retention member. The cooling of the first surface 705 may facilitate heat transfer from the refrigerant to the refrigerant conduit, housing, and/or fluid retention member, in some implementations.

Fluids 732 may be delivered to the fluid retention member through distributer 725 coupled to conduit 760. The distributor 725 coupled to the conduit 760 (e.g., fluid line from the container 750) may promote distribution of the condensate approximately evenly across at least a portion of the fluid retention member 730. The fluids 732 may include condensate from the evaporator 735 and/or water from a water line 740 (e.g., a water line may connect to a main water line of the house and/or a municipal water supply). The evaporator condensate outlet may be coupled to a sewer line.

The condensate from the evaporator 735 may be collected in a container 750 (e.g., vessel and/or tank) and/or flow directly through the conduit 760 to the fluid retention member 730.

The container 750 may be coupled to the evaporator 735 and/or the water line 740. The container 750 may restrict and/or allow flow from the evaporator 735 and/or the water line 740. For example, the container 750 may include sensors that open and close valve(s) coupled to line(s) from the evaporator 735 and/or the water line 740. The sensors may determine a fluid level in the container 750 and determine whether to allow fluid to enter the container based on the determined fluid level. In some implementations, float valve(s) may be utilized to restrict and/or allow fluid flow into the container 750 (e.g., a float valve may open the valve to allow water from a water line to enter the container when a predetermined low level is detected by the float valve and/or the float valve may close the valve to restrict water from the water line when a predetermined high level is detected by the float valve).

In some implementations, a pump 755 may be coupled to an exit line (e.g., conduit 760) from the container 750 to deliver fluid to the distributer 755. The evaporator 735 and/or container 750 may be located at a level below the fluid retention member 730 and the pump may deliver fluid from the container as desired. For example, the evaporator and/or container may be located below grade (e.g., in a basement) and the fluid retention member may be located at ground level. The pump may be utilized to deliver fluid to the fluid retention member. In some implementations, the evaporator 735 may be located in an attic, for example, and gravity may allow the fluid to flow from the container to the fluid retention member proximate ground level.

Figure 8:
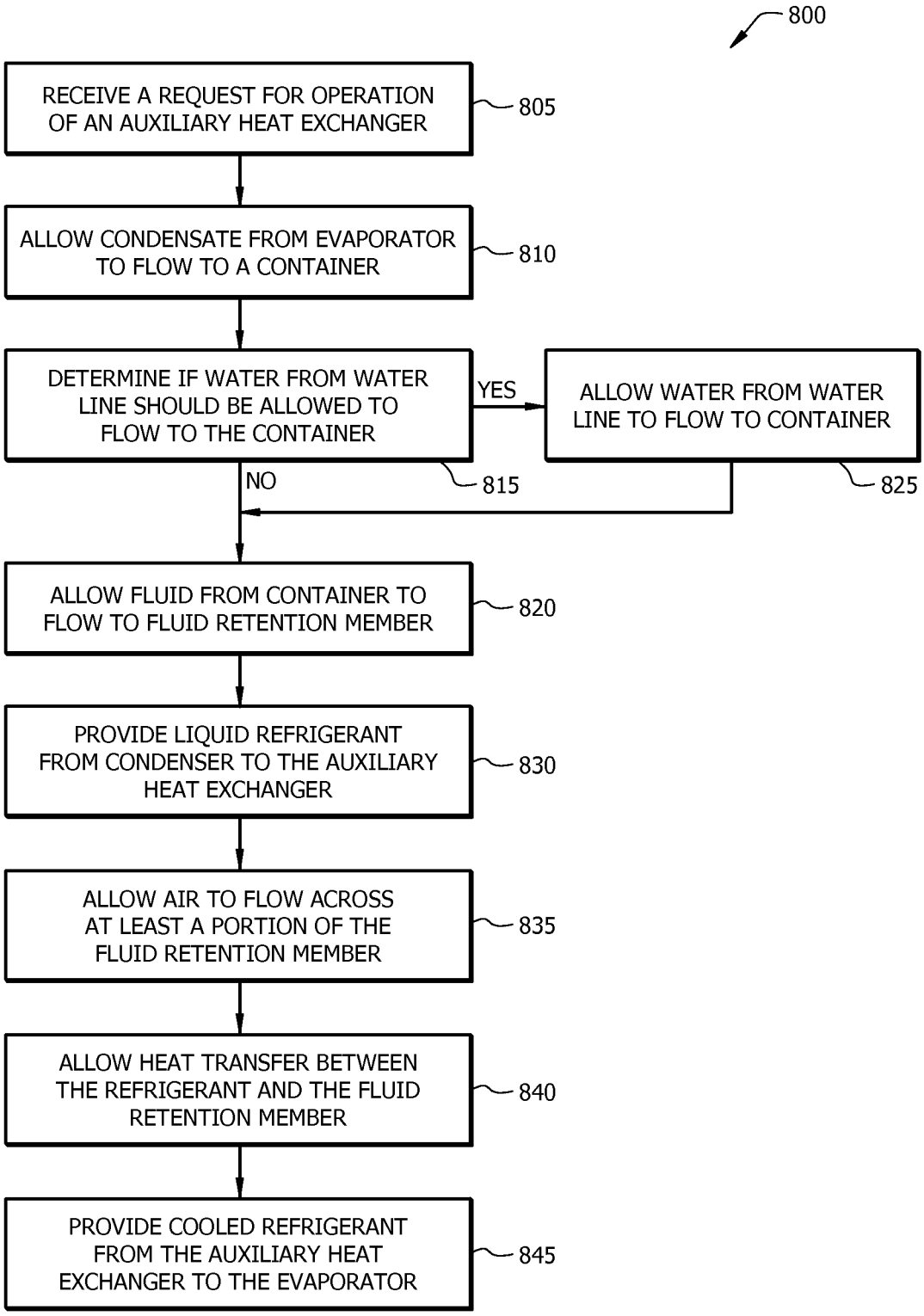
FIG. 8 illustrates an implementation of an example process for operation of an auxiliary heat exchanger.

FIG. 8 illustrates an example process 800 for operating an auxiliary heat exchanger that includes a fluid retention member. A request for the operation of the auxiliary heat exchanger may be received (operation 805). For example, a user may request operation of the auxiliary heat exchanger. The air conditioner may include default settings, such as allowing the auxiliary heat exchanger to operate unless other instructions are received and/or allowing the auxiliary heat exchanger to operate under predetermined circumstances (e.g., at predetermined temperatures, the auxiliary heat exchanger may operate or be restricted from operating).

At least a part of the condensate from the evaporator may be allowed to flow from the evaporator to the container (operation 810). For example, condensate from the evaporator may be collected and flow through a line to a container (e.g., a container containing condensate and/or water from other sources) and/or a sewer line.

A determination may be made whether water from the water line should be allowed to flow to the container (operation 815). For example, a tank level may be determined and the determination whether to open the water line valve to allow fluid flow into the container may be made based on the determined tank level. As another example, a tank level may be determined and if the tank level is greater than a predetermined maximum tank level, the condensate from the evaporator may be restricted from flowing into a container and flow into a sewer line. The use of a water line may be based at least partially on operating conditions. For example, in high humidity environments, the fluid from the evaporator may satisfy the fluid needs of the auxiliary heat exchanger and water from a water line may not be utilized. In less humid environments, the water line may be utilized to supplement the condensate collected.

If the determination is made that the water should not be allowed to flow into the container from the water line (e.g., the liquid level of fluid in the container is high), fluid from the container may be allowed to flow to the fluid retention member (operation 820). For example, a valve may restrict water flow from the water line. A pump and/or gravity may deliver the fluid from the container to the fluid retention member.

If the determination is made that water from the water line should be allowed to flow to the container, the water line may be allowed to flow to the container (operation 825) and fluid from the container may be allowed to flow to the fluid retention member (operation 820). For example, a valve may automatically open and/or close based on a level of the container and allow water from the water line to flow and/or be restricted from flowing into the container. In some implementations, a valve may not be positioned in the line from the evaporator and condensate may not be restricted from flowing into the container.

At least a part of the liquid refrigerant may be provided from the condenser to the auxiliary heat exchanger (operation 830). For example, liquid refrigerant may be allowed to flow through a conduit coupled to and/or proximate to a surface of the auxiliary heat exchanger (e.g., a second surface opposed to the first surface proximate the fluid retention member).

Air flow may be allowed to flow across at least a portion of the fluid retention member (operation 835). For example, an opening may be disposed in a housing of the auxiliary heat exchanger and air may flow at least partially through the opening and across at least a portion of the fluid retention member. The opening may be an opening in a tube (e.g., a tube with a round, oval, or other appropriately shaped cross-section) of the auxiliary heat exchanger. At least partially controlling the direction of the air flow (e.g., through the opening and/or design of the auxiliary heat exchanger) may allow control of the release of the air processed by the auxiliary heat exchanger. For example, controlling the air flow through the auxiliary heat exchanger may allow the air to return to approximately ambient temperature prior to release.

Heat transfer may be allowed between the refrigerant and the fluid retention member (operation 840). In some implementations, the fluid retention member and/or fluid (e.g., condensate and/or water from the water line) may be at a lower temperature than ambient temperature (e.g., a temperature proximate a condenser and/or auxiliary heat exchanger). The refrigerant may be at a higher temperature than ambient temperature. Heat may transfer from the higher temperature refrigerant to the fluid in the fluid retention member by the air flow across the fluid retention member (e.g., air flow through the opening in the auxiliary heat exchanger). Air flow across the fluid retention member may cool the fluid retention member (e.g., due to the evaporation of the fluid at least partially retained). Heat from the refrigerant may be transferred to the cooler fluid retention member and thus heat may be removed from the refrigerant, in some implementations.

At least a portion of the cooled refrigerant from the auxiliary heat exchanger may be provided to the evaporator (operation 845). For example, the air conditioner may include a thermal expansion valve that automatically regulates the amount of refrigerant allowed to enter the evaporator. The cooled refrigerant from the auxiliary heat exchanger may flow to the thermal expansion valve and then the evaporator.

Process 800 may be implemented by various systems, such as system 100, 200, 250, 400, 500, 700, and/or 900 (illustrated in FIG. 9). In addition, various operations may be added, deleted, or modified. For example, refrigerant from the auxiliary heat exchanger may flow directly to the evaporator. As another example, the air conditioner may be allowed to bypass the auxiliary heat exchanger and flow from the condenser to the thermal expansion valve and/or evaporator. In some implementations, a container may not be included. Condensate and/or water from the water line may be provided directly to the auxiliary heat exchanger. In some implementations, water from the water line may be allowed to flow into the container and flow from the evaporator may be restricted.

In some implementations, a thermoelectric cooler may be utilized to generate a cold zone proximate a surface of the auxiliary heat exchanger. FIG. 9 illustrates an implementation of a portion 900 of an air conditioner. As illustrated, an auxiliary heat exchanger 950 may be coupled to a power source 932 and a condenser 955. A fan 920 may provide air flow to the auxiliary heat exchanger 950 and/or the condenser 955. The power source 932 may be the same power source for the air conditioner and/or a different power source. The auxiliary heat exchanger may include a converter 925 coupled to the thermoelectric cooler 930. The converter 925 may convert, for example, alternating current from the power source 932 to a direct current for the thermoelectric cooler 930. The thermoelectric cooler 930 may be coupled to a housing 940, such as a plate, of the auxiliary heat exchanger 950. The thermoelectric cooler 930 may generate a temperature proximate a first surface 905 of the housing 940 of the auxiliary heat exchanger 950 that is lower than ambient temperature (e.g., temperature proximate the condenser 955 and/or auxiliary heat exchanger). The refrigerant in the refrigerant conduit 915 may be coupled to a second surface 910 of the housing 940 of the auxiliary heat exchanger 950 that is opposed to the first surface 905. The refrigerant in the refrigerant line 915 may be at a temperature higher than ambient temperature. Air may flow across a hot side of the thermoelectric cooler. The air may remove heat from the thermoelectric cooler and/or inhibit overheating. This may facilitate heat transfer between the thermoelectric cooler 930 and the refrigerant in the refrigerant conduit 915.

FIG. 1000 illustrates an implementation of an example process 1000 for operation of an auxiliary heat exchanger that includes a thermoelectric cooler. A request for operation of the auxiliary heat exchanger may be received (operation 1005). For example, an air conditioner may have a predetermined setting that allows operation of the auxiliary heat exchanger. The request for operation may include an initial installation design (e.g., a default setting) that directs refrigerant flow to the auxiliary heat exchanger.

A current from a power source may be provided (operation 1010). For example, the power source may be a 240V alternating current power source. The power source may be a battery. The power source may provide power to the thermoelectric cooler. A current from the power source may be converted (operation 1015). For example, an AC-DC converter may be utilized. The converted current may be provided to the thermoelectric cooler (operation 1020). For example, wires may couple the power source, converter, and/or thermoelectric cooler(s).

At least a part of the liquid refrigerant from the condenser may be provided to the auxiliary heat exchanger (operation 1025). For example, a line may couple the condenser and a portion of the auxiliary heat exchanger. Refrigerant may be allowed to flow through an inlet of the refrigerant line in the auxiliary heat exchanger and out of an outlet of the refrigerant line in the auxiliary heat exchanger.

Air may be allowed to flow across at least a portion of the thermoelectric cooler (operation 1030). For example, air may flow across at least a portion of a hot side of a thermoelectric cooler.

Heat transfer may be allowed between the refrigerant in the auxiliary heat exchanger and the thermoelectric cooler (operation 1035). The refrigerant may be at a higher temperature than the thermoelectric cooler and thus heat may be transferred to the thermoelectric cooler from the refrigerant in the refrigerant conduit. The refrigerant may exit the auxiliary heat exchanger at a temperature at or below approximately ambient temperature.

Cooled refrigerant maybe provided to the evaporator (operation 1040). For example, the refrigerant may flow to a thermal expansion valve and/or to the evaporator from the auxiliary heat exchanger. The cooled refrigerant may have a temperature of at least three degrees Fahrenheit above an ambient temperature (e.g., proximate the auxiliary heat exchanger and/or the temperature of the air disposed in the opening in the auxiliary heat exchanger). As another example, the cooled refrigerant may have a temperature below ambient temperature.

Process 1000 may be implemented by various systems, such as system 100, 200, 250, 400, 500, 700, and/or 900. In addition, various operations may be added, deleted, or modified. For example, an auxiliary heat exchanger may include a fluid retention member and a thermoelectric cooler and various operations of process 1000 and 900 may be performed. As another example, a converter may not be utilized. In some implementations, a determination may be made whether a request for operation of the auxiliary heat exchanger has been received. If the determination has been made that the request for operation of the auxiliary heat exchanger has not been received, the auxiliary heat exchanger may be bypassed. In some implementations, the refrigerant may flow though the auxiliary heat exchanger, but the auxiliary heat exchanger may be turned off (e.g., air flow from fan may be inhibited and/or the thermoelectric cooler may be turned off). When the auxiliary heat exchanger is turned off, the temperature of the refrigerant entering the auxiliary heater exchanger may not be substantially reduced.

In some implementations, the auxiliary heat exchanger and/or portions thereof may be a retrofit kit. The retrofit kit may allow existing air conditioners without auxiliary heat exchangers to be altered to include auxiliary heat exchangers. A user may couple the auxiliary heat exchanger to at least a portion of the air conditioner. A refrigerant line between a condenser and thermal expansion valve and/or evaporator may be altered such that the refrigerant flows through the auxiliary heat exchanger prior to flowing through the thermal expansion valve and/or evaporator.

In some implementations, the auxiliary heat exchanger may be provided in an air conditioner prior to operation and/or installation at a location. The air conditioner may restrict use of the air conditioner without the auxiliary heat exchanger operation, in some implementations.

In some implementations, various described system(s) and/or operation of the various described process(es) may increase an EER (energy efficiency ratio) rating and/or SEER (seasonal energy efficiency ratio) rating by at least approximately 0.5 point. The EER and/or SEER rating may be increased by from approximately 0.5 to approximately 1 point.

In various implementations, fluid, such as air from a condenser fan is described as being provided to various components of the air conditioner, such as the auxiliary heat exchanger. In some implementations, the auxiliary heat exchanger may include a fan separate from the condenser fan.

Although various lines (e.g., refrigerant line) have been described, a line may include any appropriate conduit for transporting fluids, such as tubes, pipes, and/or ducts. Although various fans have been described, any appropriate fan may be utilized, such as axial, centrifugal, etc.

Although a specific implementation of the system is described above, various components may be added, deleted, and/or modified. In addition, the fluids are described for exemplary purposes. Fluids may vary, as appropriate. For example, a refrigerant may include any appropriate heat transfer fluid. Although air has been described as provided by various fans to component(s), any appropriate fluid may be utilized. Although water has been described as being provided to a fluid retention member, container, and/or distributer, any appropriate fluid may be utilized. For example, water from the condensate and/or sewer line may include various impurities. A fluid may be a gas and/or a liquid. For example, although the refrigerant has been described as gaseous and/or liquid, the refrigerant may include gas and/or liquid in various portions of the air conditioner and/or auxiliary heat exchanger.

Although a cooling cycle has been described, the air conditioner may be operable when flow is reversed (e.g., a reversible valve may be included to reverse the flow of refrigerant in the system), in some implementations, to provide a heating cycle. In some implementations, one or more of the various described systems may be utilized and/or processes may be performed in conjunction with a system that allows cooling and/or heating, as appropriate.

Although fans have been described, any appropriate blower may be utilized (e.g., centrifugal fan, cross-flow fan, and/or axial fan). A controller may include any appropriate computing device such as a server and/or any other appropriate programmable logic device.

Although processes 600, 800, and 1000 have been described separately, various operations from processes 600, 800, and 1000 may be combined, deleted, and/or modified. For example, one or more of the operations in process 600 and one or more of the operations from process 800 may be combined. As another example, one or more of the operations from process 800 and one or more of the operations from process 1000 may be combined.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a surface" includes a combination of two or more surfaces and reference to "a fluid" includes different types and/or combinations of fluids. As another example, "water" may include components other than water and/or in addition to water. Coupling may include direct and/or indirect coupling. Although a system with one auxiliary heat exchanger and/or one type of auxiliary heat exchanger has been described, a system may include more than one auxiliary heat exchanger and/or type of heat exchanger.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A system comprising:

an auxiliary heat exchanger comprising:

a housing, the housing comprising a rectangular cube open at two ends and comprising;

a first surface comprising an inner surface of the housing and comprising one or more fluid retention members coupled to at least a portion of the first surface of the housing; and a second surface comprising an outer surface of the housing and distal to the one or more fluid retention members;

wherein the housing is configured to receive a flow of air through an interior of the housing, the flow of air able to remove heat from the first surface and the one or more fluid retention members; and a refrigerant conduit coupled to a portion of the second surface that is distal to the first surface, the refrigerant conduit comprising an inlet and an outlet to the auxiliary heat exchanger and a flow path from the inlet to the outlet;

wherein a temperature of at least a part of refrigerant in the refrigerant conduit is reduced by heat transfer from the part of the refrigerant to at least one of the fluid retention members.

2. The system of claim 1 wherein the auxiliary heat exchanger further comprises a condensate line coupled to at least one of the fluid retention members.

3. The system of claim 1 wherein the auxiliary heat exchanger further comprises a container coupled to at least one of an evaporator or a water line, and wherein a fluid leaving the container flows to at least one of the fluid retention members.

4. The system of claim 3 wherein the container automatically allows fluid to flow from the water line into the container when a fluid level in the container is less than a predetermined fluid level.

5. The system of claim 1 further comprising an air conditioner, wherein the air conditioner comprises a switch, and wherein the switch controls the operation of the auxiliary heat exchanger.

6. The system of claim 1 wherein at least one of the fluid retention members comprises channels configured to retain fluid at least partially in the channels, and wherein air flows proximate the channels, and wherein the air at least partially evaporates the fluid at least partially retained in the channels to reduce a temperature of at least a part of the refrigerant.

* * * * *